US006821360B2

(12) United States Patent
Ishii et al.

(10) Patent No.: US 6,821,360 B2
(45) Date of Patent: Nov. 23, 2004

(54) HEAT-RESISTING STEEL, METHOD FOR THERMALLY TREATING HEAT-RESISTING STEEL, AND COMPONENTS MADE OF HEAT-RESISTING STEEL

(75) Inventors: Ryuichi Ishii, Tokyo-To (JP); Yoichi Tsuda, Tokyo-To (JP); Masayuki Yamada, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/725,234

(22) Filed: Nov. 29, 2000

(65) Prior Publication Data

US 2002/0108681 A1 Aug. 15, 2002

(30) Foreign Application Priority Data

Jul. 27, 2000 (JP) ..... 2000-227213

(51) Int. Cl.[7] ..... C22C 38/18

(52) U.S. Cl. ..... 148/333; 148/334; 420/104; 420/105; 420/106; 420/108; 420/114

(58) Field of Search ..... 148/333, 334; 420/104–106, 109, 114, 108

(56) References Cited

U.S. PATENT DOCUMENTS

| | | | | |
|---|---|---|---|---|
| 5,458,703 A | * | 10/1995 | Nakai | 148/509 |
| 5,746,843 A | * | 5/1998 | Miyata et al. | 148/335 |
| 5,972,129 A | * | 10/1999 | Beguinot et al. | 148/328 |

FOREIGN PATENT DOCUMENTS

| | | | |
|---|---|---|---|
| EP | 0 787 813 A1 | | 8/1997 |
| EP | 1 081 244 A1 | | 3/2001 |
| JP | 01319629 | * | 12/1989 |
| JP | 2-217439 | | 8/1990 |
| JP | 08193240 | * | 7/1996 |
| JP | 8-246096 | | 9/1996 |
| JP | 8-325669 | | 12/1996 |
| JP | 09003590 | * | 1/1997 |
| JP | 9-41076 | | 2/1997 |
| JP | 9-268343 | | 10/1997 |
| JP | 10-81935 | | 3/1998 |
| JP | 11179407 | * | 7/1999 |

OTHER PUBLICATIONS

British Search Report dated May 31, 2002, for application No. GB0029247.4.

* cited by examiner

*Primary Examiner*—Sikyin Ip
(74) *Attorney, Agent, or Firm*—Foley & Lardner LLP

(57) ABSTRACT

A heat-resisting steel comprising 0.15–0.30 wt. % C, 0.05–0.3 wt. % Si, 0.01–0.7 wt. % Mn, 1.8–2.5 wt. % Cr, 0.15–0.23 wt. % V, 1.5–2.5 wt. % W, 0.01–0.02 wt. % Ti, 0.01–0.08 wt. % Nb, 0.005–0.03 wt. % N, 0.001–0.015 wt. % B, and Fe and unavoidable impurities as the remainder; a heat-resisting steel comprising 0.15–0.30 wt. % C, 0.05–0.3 wt. % Si, 0.01–0.7 wt. % Mn, 1.8–2.5 wt. % Cr, 0.15–0.23 wt. % V, 1.5–2.5 wt. % W, 0.3–0.8 wt. % Mo, 0.01–0.02 wt. % Ti, 0.01–0.08 wt. % Nb, 0.005–0.03 wt. % N, 0.001–0.015 wt. % B, and Fe and unavoidable impurities as the remainder; and a heat-resisting steel that is obtained by subjecting one of the above heat-resisting steels to a heat treatment comprising the step of oil-cooling the heat-resisting steel to a temperature of 300° C. or lower. These heat-resisting steels are excellent in both high-temperature strength and impact properties.

21 Claims, No Drawings

HEAT-RESISTING STEEL, METHOD FOR THERMALLY TREATING HEAT-RESISTING STEEL, AND COMPONENTS MADE OF HEAT-RESISTING STEEL

BACKGROUND OF THE INVENTION

1. Field of the Invention

The present invention relates to heat-resisting steel. More particularly, the present invention relates to heat-resisting materials suitable for use in applications where high heat resistance and good mechanical strength are required, such as steam turbine rotors.

2. Background Art

Formerly, low alloy heat resistant steel such as 1Cr-1Mo-0.25V steel, and high-chromium heat resistant steel such as 12Cr-1Mo-VNbN steel were extensively used to produce components of thermal power plants, which are required to withstand high temperatures. In recent years, however, higher steam temperatures have rapidly come to be used during the operation of thermal power plants, so that the use of high-chromium heat resistant steel, which is superior to low alloy heat resistant steel in strength and environmental resistance, has increased. It has become possible to construct plants having higher performance through the use of such high-strength steel.

Thermal power plants now tend to be required to have both high thermal efficiency and excellent profitability. It is therefore becoming essential for components of the plants to have mechanical properties and workability that are equal to or better than those of conventional ones, and, in addition, to be excellent in profitability.

SUMMARY OF THE INVENTION

An object of the present invention is to provide heat-resisting steel that is stable even in high steam temperature environments and that has excellent profitability.

We made studies to develop low alloy heat resistant steel having high-temperature strength comparable to that of high-chromium heat resistant steel, and, as a result, finally attained the present invention.

A first heat-resisting steel according to the present invention comprises 0.15–0.30 wt. % C, 0.05–0.3 wt. % Si, 0.01–0.7 wt. % Mn, 1.8–2.5 wt. % Cr, 0.15–0.23 wt. % V, 1.5–2.5 wt. % W, 0.01–0.02 wt. % Ti, 0.01–0.08 wt. % Nb, 0.005–0.03 wt. % N, 0.001–0.015 wt. % B, and Fe and unavoidable impurities as the remainder.

A second heat-resisting steel according to the present invention comprises 0.15–0.30 wt. % C, 0.05–0.3 wt. % Si, 0.01–0.7 wt. % Mn, 1.8–2.5 wt. % Cr, 0.15–0.23 wt. % V, 1.5–2.5 wt. % W, 0.3–0.8 wt. % Mo, 0.01–0.02 wt. % Ti, 0.01–0.08 wt. % Nb, 0.005–0.03 wt. % N, 0.001–0.015 wt. % B, and Fe and unavoidable impurities as the remainder.

A third heat-resisting steel according to the present invention is the above first or second heat-resisting steel in which all of Nb and a part of Fe are replaced with V and/or Ti to make the V content 0.23 (exclusive)–0.35 wt. %, and the Ti content 0.02 (exclusive)–0.03 wt. %, the heat-resisting steel thus containing no Nb other than that existing as the impurity.

A fourth heat-resisting steel according to the present invention is the above first or second heat-resisting steel in which all of Nb and Ti, and a part of Fe are replaced with V to make the V content 0.23 (exclusive)–0.35 wt. %, the heat-resisting steel thus containing no Nb and Ti other than those existing as the impurities.

A fifth heat-resisting steel according to the present invention is the above third or fourth heat-resisting steel in which a part of Fe is replaced with Ni to make the Ni content 0.1–3.0 wt. %.

A sixth heat-resisting steel according to the present invention is the above third or fourth heat-resisting steel in which a part of Fe is replaced with Cu to make the Cu content 0.1–3.0 wt. %.

A seventh heat-resisting steel according to the present invention is obtained by subjecting any of the above first to sixth heat-resisting steels to a heat treatment comprising the steps of normalizing the heat-resisting steel, and oil-cooling the normalized heat-resisting steel to a temperature of 300° C. or lower.

An eighth heat-resisting steel according to the present invention is any of the above first to seventh heat-resisting steels, useful for producing steam turbine rotors.

DETAILED DESCRIPTION OF THE INVENTION

The heat resisting steels according to the present invention have chemical compositions that fall in the ranges specified on the grounds as described below. In the following description, "%" is "% by weight" unless otherwise specified.

(a) C

C ensures high hardenability, and is also an important constituent element of carbides that will participate in precipitation hardening. In the heat-resisting steels according to the present invention, the above properties of C cannot fully be developed when the C content is less than 0.15%. On the other hand, C contents in excess of 0.30% not only facilitate the coagulation of carbides, but also increase segregation that occurs when the steels are solidified. For this reason, the range of C contents proper in the present invention is from 0.15 to 0.30%.

(b) Si

Si serves as a deoxidizing agent, and also increases the resistance to water vapor oxidation. However, high Si contents decrease the toughness, and facilitate the development of brittleness. From this point of view, it is desirable to make the Si content as low as possible. In the heat-resisting steels according to the present invention, when the Si content is in excess of 0.3%, the above favorable properties of Si can scarcely be developed. Therefore, the Si content range proper in the present invention is between 0.05% and 0.3% inclusive.

(c) Mn

Mn is an element having a desulfurizing effect, but this effect cannot be observed when the Mn content is less than 0.01%. On the other hand, the addition of more than 0.7% of Mn decreases the creep strength. The Mn content range proper in the present invention is therefore from 0.01 to 0.7%.

(d) Cr

Cr not only imparts resistance to oxidation and corrosion, but also is an important constituent element of precipitates that will participate in precipitation hardening. In the heat-resisting steels according to the present invention, the above properties of Cr cannot sufficiently be developed when the Cr content is less than 1.8%, while the toughness is decreased when the Cr content is made more than 2.5%. For this reason, from 1.8 to 2.5% is the proper Cr content range in the present invention.

(e) V

V participates in solid-dissolution hardening, and contributes to the formation of fine carbonitrides. In the heat-resisting steels according to the present invention, when 0.15% or more of V is added, fine carbonitrides fully precipitate to suppress recovery. In the case where V is added in combination with Nb, if the V content exceeds 0.23%, the toughness is decreased, and, at the same time, the coarsening of carbonitrides is facilitated. The V content range proper in this case is therefore from 0.15 to 0.23%. In the case where all of Nb and a part of Fe are replaced with V, it is necessary to make the V content higher than 0.23% in order to ensure high precipitation density of fine carbonitrides that will participate in precipitation hardening. However, in the heat-resisting steels according to the present invention, when the V content is made higher than 0.35%, not only the toughness is decreased, but also the coarsening of carbonitrides is facilitated. For this reason, from 0.23 to 0.35% is the V content range proper in this case.

(f) W

W participates in solid-dissolution hardening, and also in precipitation hardening as a substituent of carbides. To keep the quantity of solid solution great over a long period of time, it is necessary to add 1.5% or more of W. However, when the W content is made higher than 2.5%, the toughness is decreased, and the formation of ferrite is facilitated. For this reason, the range of W contents proper in the present invention is from 1.5 to 2.5%.

(g) Mo

Mo is important as an element that participates in solid-dissolution hardening, and also as a constituent element of carbides. These properties of Mo are fully developed when the Mo content is 0.3% or more. In the heat-resisting steels of the present invention, however, Mo contents of 0.8% or more not only decrease the toughness, but also facilitate the formation of ferrite. The range of Mo contents proper in the present invention is therefore from 0.3 to 0.8%.

(h) B

B improves the hardenability, and makes carbonitrides stable at high temperatures over a prolonged period of time even when the amount of B added is extremely small. In the heat-resisting steels according to the present invention, these effects of B are observed when the B content is 0.001% or higher, and, in this case, there can be obtained the effect of preventing the coarsening of carbides that precipitate at the grain boundaries or in the vicinity thereof. However, when the B content is made higher than 0.015%, the formation of coarse products is facilitated. For this reason, from 0.001 to 0.015% is the range of B contents proper in the present invention.

(i) N

N participates in precipitation hardening by giving either nitrides or carbonitrides. Moreover, N remaining in the mother phase also participates in solid-dissolution hardening. In the heat-resisting steels according to the present invention, these properties of N are not developed when the N content is less than 0.005%. On the other hand, when the N content is made 0.03% or more, the coarsening of nitrides or carbonitrides is facilitated to decrease the creep resistance, and also to facilitate the formation of coarse products. For this reason, between 0.005% and 0.03% inclusive is the N content range proper in the present invention.

(j) Ti

Ti acts as a deoxidizing agent, and contributes to the formation of fine carbonitrides. In the heat-resisting steels according to the present invention, these properties of Ti can be observed when the Ti content is 0.01% or more. However, in the case where Ti is added in combination with Nb, if the Ti content is made higher than 0.02%, the formation of coarse carbonitrides is facilitated. Therefore, the Ti content range proper in this case is from 0.01to 0.02%. In the case where all of Nb is replaced with Ti, or Ti and Fe, it is necessary to make the Ti content higher than 0.02% in order to ensure high precipitation density of fine carbonitrides that will participate in precipitation hardening. However, in the heat-resisting steels according to the present invention, Ti contents higher than 0.03% not only bring about decrease in toughness, but also facilitate the coarsening of carbonitrides. For this reason, the Ti content range proper in this case is from 0.02 to 0.03%.

(k) Nb

Nb participates in precipitation hardening by giving fine carbonitrides, but this property of Nb cannot be developed when the Nb content is less than 0.01%. On the other hand, when the Nb content is made higher than 0.08%, segregation increases, and the percentage by volume of coarse Nb (C,N) that has not been solid-dissolved becomes high. The toughness and notch sensitivity are thus decreased. Therefore, the Nb content range proper in the present invention is from 0.01 to 0.08%. When Nb is replaced with Fe, the above property of Nb cannot be observed. However, in the heat-resisting steels according to the present invention, it is possible to attain the formation of carbonitrides by adding V and/or Ti in an increased amount.

(l) Ni

Ni improves the hardenability and toughness. In the heat-resisting steels according to the present invention, these properties of Ni can be observed when the Ni content is 0.1% or higher. However, Ni contents exceeding 3.0% decrease the creep strength. Therefore, from 0.1 to 3.0% is the range of Ni contents proper in the present invention.

(m) Cu

Cu improves the hardenability and toughness. In the heat-resisting steels according to the present invention, the effects of Cu can be obtained when 0.01% or more of Cu is added. However, Cu contents higher than 3.0% drastically decrease the forgeability. For this reason, the Cu content range proper in the present invention is from 0.1 to 3.0%.

With respect to those impurities that concomitantly come into the steels when the above-described elements are added to Fe, main element, it is desirable to make their amount as low as possible.

Next, the reason why the above heat-resisting steels are subjected to a treatment comprising the steps of normalizing the heat-resisting steel, and oil-cooling the normalized heat-resisting steel to a temperature of 300° C. or lower will be described.

The heat-resisting steels according to the present invention contain relatively large amounts of ferrite-forming elements, so that they develop ferrite in a short time as compared with steels of conventional types. Therefore, if the heat-resisting steels of the invention are cooled in the air after they are normalized as in the case of steels of conventional types, ferrite, which exerts adverse effects on the textural stability and properties, is unavoidably formed during the step of cooling. To avoid this phenomenon, such a manner that oil cooling is conducted after normalizing treatment is adopted in the present invention. Further, the transformation of the structure of the heat-resisting steels according to the invention into bainite is completed at approximately 300° C., so that it becomes possible to obtain heat-resisting steels having more stable metallic structure when the heat-resisting steels of the invention are cooled to this temperature or lower.

In the present invention, the normalizing heat treatment is carried out in such a manner that the heat-resisting steel is heated at a temperature between 950° C. and 1,070° C., preferably between 970° C. and 1,050° C., for a predetermined period of time. When the heat-resisting steel is heated at a temperature lower than 950° C., there remain coarse carbonitrides that have not been solid-dissolved. On the other hand, when the heat-resisting steel is heated at a temperature higher than 1,070° C., the steel readily develops an injurious ferrite phase. For this reason, the above-described temperature range is preferred.

EXAMPLES

The present invention will now be explained more specifically by referring to the following examples in which heat-resisting steels having chemical compositions as shown in Table 1 were used.

Example 1

This example is to show that the first and second heat-resisting steels having the chemical compositions comprising 0.15–0.30 wt. % C, 0.05–0.3 wt. % Si, 0.01–0.7 wt. % Mn, 1.8–2.5 wt. % Cr, 0.15–0.23 wt. % V, 1.5–2.5 wt. % W, 0.01–0.02 wt. % Ti, 0.01–0.08 wt. % Nb, 0.005–0.03 wt. % N, 0.001–0.015 wt. % B, and Fe and unavoidable impurities as the remainder or comprising 0.15–0.30 wt. % C, 0.05–0.3 wt. % Si, 0.01–0.7 wt. % Mn, 1.8–2.5 wt. % Cr, 0.15–0.23 wt. % V, 1.5–2.5 wt. % W, 0.3–0.8 wt. % Mo, 0.01–0.02 wt. % Ti, 0.01–0.08 wt. % Nb, 0.005–0.03 wt. % N, 0.001–0.015 wt. % B, and Fe and unavoidable impurities as the remainder, respectively, have excellent properties.

30 kg of sample steel was subjected to vacuum induction fusion, and then to casting. The cast ingot was forged at a high temperature, annealed, and then normalized. This was subjected to oil hardening, followed by tempering. The chemical compositions of the steels obtained in this manner are as shown in Table 1.

Of the heat-resisting steels shown in the table, P1 to P8 are heat-resisting steels whose chemical compositions fall in the ranges comprising 0.15–0.30 wt. % C, 0.05–0.3 wt. % Si, 0.01–0.7 wt. % Mn, 1.8–2.5 wt. % Cr, 0.15–0.23 wt. % V, 1.5–2.5 wt. % W, 0.01–0.02 wt. % Ti, 0.01–0.08 wt. % Nb, 0.005–0.03 wt. % N, 0.001–0.015 wt. % B, and Fe and unavoidable impurities as the remainder or comprising 0.15–0.30 wt. % C, 0.05–0.3 wt. % Si, 0.01–0.7 wt. % Mn, 1.8–2.5 wt. % Cr, 0.15–0.23 wt. % V, 1.5–2.5 wt. % W, 0.3–0.8 wt. % Mo, 0.01–0.02 wt. % Ti, 0.01–0.08 wt. % Nb, 0.005–0.03 wt. % N, 0.001–0.015 wt. % B, and Fe and unavoidable impurities as the remainder (in this example, referred to as the heat-resisting steels of the present invention), and C1, C2, C4 and C5 are heat-resisting steels whose chemical compositions are not within these ranges (hereinafter referred to as the comparative heat-resisting steels). All of these steels have been controlled to have a tensile strength of approximately 750 MPa.

Times taken by these heat-resisting steels before they ruptured, measured by conducting a creep rupture test are as shown in Table 2. The heat-resisting steels of the present invention took longer times before undergoing rupture than the comparative heat-resisting steels C1, C2, C4 and C5. The impact-absorbing energies of the heat-resisting steels, determined by carrying out a sharpy impact test at a temperature of 20° C. are shown in Table 2. The heat-resisting steels of the present invention showed high impact-absorbing energies as compared with the comparative heat-resisting steels C1, C2, C4, and C5.

The above-described results demonstrate that the heat-resisting steels of the present invention are more excellent in creep characteristics and impact properties than the comparative heat-resisting steels when they have the same tensile strength.

Example 2

This example is to show that the third and fourth heat-resisting steels having the chemical compositions as defined in the preceeding example but wherein all of Nb and a part of Fe are replaced with V and/or Ti to make the V content 0.23 (exclusive)–0.35 wt, %, and the Ti content 0.02 (exclusive)–0.03 wt. %, the heat-resisting steel thus containing no Nb other than that existing as the impurity or wherein all of Nb and Ti, and a part of Fe are replaced with V to make the V content 0.23 (exclusive)–0.35 wt. %, the heat-resisting steel thus containing no Nb and Ti other than those existing as the impurities, respectively, have excellent properties.

The same production method as in Example 1 was employed to obtain heat-resisting steels. The chemical compositions of these steels are as shown in Table 1.

Of the heat-resisting steels shown in the table, P9 to P18 are heat-resisting steels whose chemical compositions are in the ranges of the preceeding example, but wherein all of Nb and a part of Fe are replaced with V and/or Ti to make the V content 0.23 (exclusive)–0.35 wt, %, and the Ti content 0.02 (exclusive)–0.03 wt. %, the heat-resisting steel thus containing no Nb other than that existing as the impurity or wherein all of Nb and Ti, and a part of Fe are replaced with V to make the V content 0.23 (exclusive)–0.35 wt. %, the heat-resisting steel thus containing no Nb and Ti other than those existing as the impurities or (in this example, referred to as the heat-resisting steels of the present invention); and C1–C3, C6 and C7 are comparative heat-resisting steels whose chemical compositions are not in the ranges set forth above. All of these heat-resisting steels have been controlled to have a tensile strength of approximately 750 MPa.

Times taken by these heat-resisting steels before they ruptured, measured by conducting a creep rupture test are as shown in Table 2. The heat-resisting steels of the present invention took longer times before undergoing rupture than the comparative heat-resisting steels C1–C3, C6 and C7. The impact-absorbing energies of the heat-resisting steels, determined by conducting a Sharpy impact test at a temperature of 20° C. are shown in Table 2. The heat-resisting steels of the present invention showed high impact-absorbing energies as compared with the comparative heat-resisting steels C1–C3, C6 and C7.

The above-described results demonstrate that the heat-resisting steels of the present invention are more excellent in creep characteristics and impact properties than the comparative heat-resisting steels when they have the same tensile strength.

Example 3

This example is to show that the fifth and sixth heat-resisting steels having the chemical compositions of the preceeding example but wherein a part of Fe is replaced with Ni to make the Cu content 0.1–3.0 wt. % or wherein a part of Fe is replaced with Cu to make the Cu content 0.1–3.0 wt. %, respectively, have excellent properties.

The same production method as in Example 1 was employed to obtain heat-resisting steels. The chemical compositions of these steels are as shown in Table 1.

Of the heat-resisting steels shown in the table, P19 to P24 are heat-resisting steels whose chemical compositions fall in the ranges of the preceeding example but wherein a part of Fe is replaced with Ni to make the Cu content 0.1–3.0 wt. % or wherein a part of Fe is replaced with Cu to make the Cu content 0.1–3.0 wt. % (in this example, referred to as the heat-resisting steels of the present invention); and C1–C9 are heat-resisting steels whose chemical compositions do not fall in these ranges (hereinafter referred to as the comparative heat-resisting steels). All of these heat-resisting steels have been controlled to have a tensile strength of approximately 750 MPa.

Times taken by these heat-resisting steels before they ruptured, measured by conducting a creep rupture test, and impact-absorbing energies of the heat-resisting steels, determined by conducting a Sharpy impact test at a temperature of 20° C. are as shown in Table 2. The heat-resisting steels of the present invention are superior to the comparative ones in both time taken before undergoing rupture and impact-absorbing energy, or at least in impact-absorbing energy even if they are inferior to the comparative ones in time taken before undergoing rupture.

The above-described results demonstrate that the heat-resisting steels of the present invention are more excellent in both creep characteristics and impact properties than the comparative heat-resisting steels when they have the same tensile strength; or the heat-resisting steels of the present invention show remarkably increased impact-absorbing energies as compared with the conventional ones.

Example 4

This example is to explain the reason why the heat-resisting steel normalized is oil-cooled to a temperature of 300° C. or lower. P1, P7, P9, P16, P19 and P22, heat-resisting steels of the present invention, and C1, comparative heat-resisting steel, were subjected to a hardening treatment comprising the steps of heating the heat-resisting steel to 1,050° C., and oil- or air-cooling it to a temperature of 300° C. or lower. The structures of the heat-resisting steels thus treated are as shown in Table 3.

P1, heat-resisting steel of the present invention, and C1, comparative heat-resisting steel, each containing only a small amount of ferrite-forming elements, did not develop α-ferrite even when they were cooled in the air. P7, P9, P16, P19 and P22, each containing a relatively large amount of ferrite-forming elements, developed both bainite and ferrite when they were cooled in the air. These heat-resisting steels of the present invention developed only bainite when they were subjected to oil cooling after the normalizing heat treatment.

It can thus be known that the heat-resisting steels of the present invention never develop ferrite but uniformly develop bainite when they are subjected to the heat treatment method according to the present invention.

The heat-resisting steels according to the present invention can be used for a variety of applications thanks to their high heat resistance and good mechanical strength. It is particularly preferable to use the heat-resisting steels of the present invention as materials for producing steam turbine rotors. In this case, the compositions of the heat-resisting steels and the conditions under which the steels are normalized may properly be varied, within the above-described ranges, depending upon various properties, workability, durability, profitability and the like that are required for materials to be used to produce steam turbine rotors.

TABLE 1

| | Type of Steel | C | Si | Mn | Cr | V | W | Mo | Ti | Nb | N | B | Others | Fe |
|---|---|---|---|---|---|---|---|---|---|---|---|---|---|---|
| Example | P1 | 0.28 | 0.07 | 0.49 | 2.22 | 0.16 | 1.61 | - | 0.012 | 0.06 | 0.011 | 0.005 | - | Balance |
| | P2 | 0.25 | 0.25 | 0.51 | 2.25 | 0.23 | 1.53 | - | 0.019 | 0.02 | 0.009 | 0.008 | - | Balance |
| | P3 | 0.28 | 0.05 | 0.49 | 2.42 | 0.22 | 1.78 | - | 0.015 | 0.05 | 0.025 | 0.002 | - | Balance |
| | P4 | 0.16 | 0.08 | 0.46 | 1.91 | 0.19 | 2.03 | - | 0.012 | 0.07 | 0.012 | 0.014 | - | Balance |
| | P5 | 0.27 | 0.06 | 0.42 | 2.28 | 0.18 | 1.59 | 0.78 | 0.020 | 0.03 | 0.022 | 0.006 | - | Balance |
| | P6 | 0.24 | 0.05 | 0.45 | 2.16 | 0.22 | 1.68 | 0.60 | 0.018 | 0.02 | 0.028 | 0.006 | - | Balance |
| | P7 | 0.17 | 0.05 | 0.51 | 2.23 | 0.23 | 1.91 | 0.47 | 0.018 | 0.03 | 0.015 | 0.008 | - | Balance |
| | P8 | 0.19 | 0.08 | 0.49 | 2.35 | 0.22 | 2.41 | 0.32 | 0.017 | 0.03 | 0.013 | 0.005 | - | Balance |
| | P9 | 0.18 | 0.11 | 0.02 | 1.98 | 0.18 | 2.35 | 0.31 | 0.028 | - | 0.016 | 0.012 | - | Balance |
| | P10 | 0.26 | 0.06 | 0.22 | 2.43 | 0.27 | 2.00 | 0.51 | 0.025 | - | 0.013 | 0.008 | - | Balance |
| | P11 | 0.22 | 0.24 | 0.51 | 2.13 | 0.25 | 1.78 | 0.65 | 0.021 | - | 0.020 | 0.010 | - | Balance |
| | P12 | 0.24 | 0.09 | 0.48 | 2.26 | 0.24 | 1.61 | 0.77 | 0.023 | - | 0.025 | 0.006 | - | Balance |
| | P13 | 0.23 | 0.09 | 0.23 | 2.31 | 0.31 | 2.44 | - | 0.023 | - | 0.019 | 0.007 | - | Balance |
| | P14 | 0.21 | 0.09 | 0.12 | 2.24 | 0.31 | 1.95 | 0.50 | - | - | 0.025 | 0.007 | - | Balance |
| | P15 | 0.20 | 0.18 | 0.10 | 2.20 | 0.33 | 2.48 | - | - | - | 0.018 | 0.012 | - | Balance |
| | P16 | 0.25 | 0.16 | 0.04 | 2.25 | 0.25 | 1.74 | 0.65 | - | - | 0.021 | 0.010 | - | Balance |
| | P17 | 0.19 | 0.25 | 0.28 | 2.19 | 0.28 | 2.19 | 0.39 | - | - | 0.022 | 0.008 | - | Balance |
| | P18 | 0.20 | 0.21 | 0.15 | 2.09 | 0.27 | 1.67 | 0.77 | - | - | 0.023 | 0.007 | - | Balance |

TABLE 1-continued

| | | | | | | | | | | | | | | |
|---|---|---|---|---|---|---|---|---|---|---|---|---|---|---|
| | P19 | 0.28 | 0.15 | 0.08 | 2.23 | 0.24 | 1.68 | 0.33 | 0.025 | - | 0.012 | 0.014 | Ni:0.12 | Balance |
| | P20 | 0.20 | 0.09 | 0.49 | 2.25 | 0.25 | 1.75 | 0.26 | - | - | 0.016 | 0.009 | Ni:0.15 | Balance |
| | P21 | 0.23 | 0.25 | 0.18 | 1.87 | 0.32 | 2.48 | - | 0.027 | - | 0.008 | 0.007 | Ni:2.82 | Balance |
| | P22 | 0.19 | 0.28 | 0.15 | 2.10 | 0.25 | 1.82 | 0.70 | 0.021 | - | 0.014 | 0.013 | Cu:0.16 | Balance |
| | P23 | 0.22 | 0.11 | 0.47 | 2.23 | 0.28 | 2.44 | - | - | - | 0.011 | 0.007 | Cu:1.51 | Balance |
| | P24 | 0.22 | 0.19 | 0.17 | 2.09 | 0.24 | 2.36 | - | 0.029 | - | 0.009 | 0.014 | Cu:2.73 | Balance |
| Comparative Example | C1 | 0.18 | 0.35 | 0.68 | 1.22 | 0.26 | - | 1.02 | - | - | 0.009 | - | - | Balance |
| | C2 | 0.14 | 0.25 | 0.51 | 10.1 | 0.22 | - | 0.90 | - | 0.10 | 0.041 | - | - | Balance |
| | C3 | 0.32 | 0.32 | 0.82 | 2.27 | 0.22 | 1.02 | 1.03 | 0.02 | - | 0.001 | - | - | Balance |
| | C4 | 0.20 | 0.24 | 0.18 | 2.75 | 0.22 | 264 | - | 0.018 | 0.06 | 0.016 | 0.018 | - | Balance |
| | C5 | 0.19 | 0.24 | 0.18 | 2.25 | 0.14 | 1.75 | 0.88 | 0.035 | 0.04 | 0.011 | 0.005 | - | Balance |
| | C6 | 0.16 | 0.23 | 0.21 | 2.31 | 0.36 | 1.66 | 0.72 | - | - | 0.018 | - | - | Balance |
| | C7 | 0.17 | 0.29 | 0.08 | 2.06 | 0.21 | 1.82 | 0.58 | - | - | 0.012 | - | - | Balance |
| | C8 | 0.20 | 0.19 | 0.48 | 1.98 | 0.25 | 1.88 | 0.35 | 0.021 | - | 0.015 | 0.003 | Ni:3.22 | Balance |
| | C9 | 0.18 | 0.21 | 0.52 | 2.08 | 0.26 | 1.76 | 0.41 | 0.025 | - | 0.014 | 0.005 | Cu:3.20 | Balance |

: Value not in the ranges of the invention

TABLE 2

| | Type of Steel | Tensile Strength at Normal Temperatures (MPa) | Time Taken before Undergoing Creep Rupture at 600° C.-Under 196 MPa (h) | Impact-Absorbing Energy at 20° C. (J) |
|---|---|---|---|---|
| Example | P1 | 764 | 887 | 163 |
| | P2 | 748 | 992 | 128 |
| | P3 | 736 | 839 | 135 |
| | P4 | 735 | 1050 | 102 |
| | P5 | 770 | 1508 | 92 |
| | P6 | 738 | 1397 | 86 |
| | P7 | 732 | 1460 | 152 |
| | P8 | 730 | 1342 | 117 |
| | P9 | 745 | 1163 | 121 |
| | P10 | 752 | 1282 | 148 |
| | P11 | 750 | 1433 | 166 |
| | P12 | 738 | 1345 | 160 |
| | P13 | 735 | 1068 | 78 |
| | P14 | 748 | 1367 | 168 |
| | P15 | 733 | 1460 | 72 |
| | P16 | 758 | 1120 | 155 |
| | P17 | 768 | 1132 | 128 |
| | P18 | 740 | 1303 | 150 |
| | P19 | 765 | 1158 | 147 |
| | P20 | 725 | 1093 | 165 |
| | P21 | 740 | 382 | 254 |
| | P22 | 738 | 1120 | 142 |
| | P23 | 740 | 1075 | 128 |
| | P24 | 753 | 1021 | 108 |
| Comparative Example | C1 | 732 | 56 | 29 |
| | C2 | 772 | 588 | 47 |
| | C3 | 768 | 636 | 68 |
| | C4 | 752 | 812 | 35 |
| | C5 | 740 | 625 | 82 |
| | C6 | 762 | 925 | 94 |
| | C7 | 765 | 785 | 105 |
| | C8 | 756 | 112 | 235 |
| | C9 | 772 | 725 | 32 |

TABLE 3

| | Type of Steel | Structure |
|---|---|---|
| Oil cooling (Example) | P1 | Bainite |
| | P7 | Bainite |
| | P9 | Bainite |
| | P16 | Bainite |
| | P19 | Bainite |
| | P22 | Bainite |
| | C1 | Bainite |
| Air Cooling (Comparative Example) | P1 | Bainite |
| | P7 | Bainite + Ferrite |
| | P9 | Bainite + Ferrite |
| | P16 | Bainite + Ferrite |
| | P19 | Bainite + Ferrite |
| | P22 | Bainite + Ferrite |
| | C1 | Bainite |

The heat-resisting steels of the present invention, and steam turbine rotors made of the heat-resisting steels of the invention that have been treated by the heat treatment method according ti the present invention are excellent in both high-temperature strength arid impact properties. The present invention can thus improve the performance, operation characteristics and profitability of steam turbine rotor showing that the present invention is industrially advantageous.

What is claimed is:

1. A heat-resisting steel consisting essentially of 0.20 (exclusive)–0.30 wt. % C, 0.05 (exclusive)–0.30 wt. % Si, 0.01–0.7 wt. % Mn, 1.8–2.5 wt. % Cr, 0.15–0.23 wt. % V, 1.5–2.5 wt. % W, 0.01–0.02 wt. % Ti, 0.01–0.08 wt. % Nb, 0.005–0.03 wt. % N, 0.001–0.015 wt. % B, and Fe and unavoidable impurities as the remainder, wherein the heat-resisting steel consists of a bainite single phase.

2. A heat-resisting steel that is obtained by subjecting a heat-resisting steel according to claim 1 to a heat treatment comprising the steps of normalizing the heat-resisting steel, and oil-cooling the normalized heat-resisting steel to a temperature of 300° or lower.

3. A steam turbine rotor comprising the heat-resisting steel according to claim 1.

4. The heat-resisting steel according to claim 1, wherein the content of C is 0.21–0.30 wt %.

5. A heat-resisting steel consisting essentially of 0.20 (exclusive)–0.30 wt. % C, 0.05 (exclusive)–0.30 wt. % Si, 0.01–0.7 wt. % Mn, 1.8–2.5 wt. % Cr, 1.5–2.5 wt. % W, 0.23 (exclusive)–0.35 wt. % V, 0.02 (exclusive)–0.03 wt. % Ti, 0.005–0.03 wt. % N, 0.00 1–0.015 wt. % B, and Fe and unavoidable impurities as the remainder, wherein the heat-resisting steel consists of a bainite single phase.

6. The heat-resisting steel according to claim 5, wherein the content of C is 0.21–0.30 wt %.

7. A steam turbine rotor comprising the heat-resisting steel according to claim 5.

8. A heat-resisting steel consisting essentially of 0.20 (exclusive)–0.30 wt. % C, 0.05 (exclusive)–0.30 wt. % Si, 0.01–0.7 wt. % Mn, 1.8–2.5 wt. % Cr, 0.23 (exclusive)–0.35 wt. % V, 1.5–2.5 wt. % W, 0.005–0.03 wt. % N, 0.001–0.015 wt. % B, and Fe and unavoidable impurities as the remainder, wherein the heat-resisting steel consists of a bainite single phase.

9. The heat-resisting steel according to claim 8, which further comprises 0.1–3.0 wt. % Ni.

10. The heat-resisting steel according to claim 8, which further comprises 0.1–3.0 wt. % Cu.

11. The heat-resisting steel according to claim 8, wherein the content of C is 0.21–0.30 wt %.

12. A steam turbine rotor comprising the heat-resisting steel according to claim 8.

13. A heat-resisting steel consisting essentially of 0.15–0.30 wt. % C, 0.05 (exclusive)–0.30 wt. % Si, 0.01–0.7 wt. % Mn, 1.8–2.5 wt. % Cr, 0.15–0.23 wt. % V. 1.5–2.5 wt. % W, 0.3–0.8 wt. % Mo, 0.01–0.02 wt. % Ti, 0.01–0.08 wt. % Nb, 0.005–0.03 wt. % N, 0.001–0.015 wt. % B, and Fe and unavoidable impurities as the remainder, wherein the heat-resisting steel consists of a bainite single phase.

14. A heat-resisting steel that is obtained by subjecting a heat-resisting steel according to claim 13 to a heat treatment comprising the steps of normalizing the heat-resisting steel, and oil-cooling the normalized heat-resisting steel to a temperature of 300° or lower.

15. A steam turbine rotor comprising the heat-resisting steel according to claim 13.

16. A heat-resisting steel consisting essentially of 0.15–0.30 wt. % C, 0.05 (exclusive)–0.30 wt. % Si, 0.01–0.7 wt. % Mn, 1.8–2.5 wt. % Cr, 1.5–2.5 wt. % W, 0.3–0.8 wt. % Mo, 0.23 (exclusive)–0.35 wt. % V. 0.02 (exclusive)–0.03 wt. % Ti, 0.005–0.03 wt. % N, 0.001–0.015 wt. % B, and Fe and unavoidable impurities as the remainder, wherein the heat-resisting steel consists of a bainite single phase.

17. A steam turbine rotor comprising the heat-resisting steel according to claim 16.

18. A heat-resisting steel consisting essentially of 0.15–0.30 wt. % C, 0.05 (exclusive)–0.30 wt. % Si, 0.01–0.7 wt. % Mn, 1.8–2.5 wt. % Cr, 0.23 (exclusive)–0.35 wt. % V, 1.5–2.5 wt. % W, 0.3–0.8 wt. % Mo, 0.005–0.03 wt. % N, 0.001–0.015 wt. % B, and Fe and unavoidable impurities as the remainder, wherein the heat-resisting steel consists of a bainite single phase.

19. The heat-resisting steel according to claim 18, which further comprises 0.1–3.0 wt. % Ni.

20. The heat-resisting steel according to claim 18, which further comprises 0.1–3.0 wt. % Cu.

21. A steam turbine rotor comprising the heat-resisting steel according to claim 18.

* * * * *